US006128802A

United States Patent [19]

Lye

[11] Patent Number: 6,128,802

[45] Date of Patent: Oct. 10, 2000

[54] PAINT ROLLER HAVING A DEVICE FOR FASTENING SECURELY ROLLER COVER

[75] Inventor: Sander Lye, Taipei, Taiwan

[73] Assignee: Pro-Charger Co. Ltd., Taipei, Taiwan

[21] Appl. No.: 09/076,778

[22] Filed: May 13, 1998

[51] Int. Cl.[7] ..... B05C 1/08

[52] U.S. Cl. ..... 15/230.11; 492/19

[58] Field of Search ..... 15/230, 230.11; 492/13, 17, 19

[56] References Cited

U.S. PATENT DOCUMENTS

| | | | |
|---|---|---|---|
| 4,897,893 | 2/1990 | Barker | 15/230.11 |
| 5,755,004 | 5/1998 | Miller | 15/230.11 |
| 5,806,129 | 9/1998 | Nelson | 15/230.11 |

*Primary Examiner*—Terrence R. Till
*Attorney, Agent, or Firm*—Browdy and Neimark

[57] ABSTRACT

A paint roller consists of a handle, a shaft extending form one end of the handle, a fastening member fastened rotatably engaged on with the rotary shaft and composed of a first cover body and a second cover body, and a roller cover fitted over the fastening member such that one end of the roller cover is located and sealed off by a retaining portion of the first cover body, and that another end of the roller cover is located and sealed off by an elastic protuberance of the second cover body, and further that the roller cover is confined by the retaining portion and the elastic protuberance to prevent the roller cover from displacing along the direction of the longitudinal axis of the fastening member. The paint deposited in the fastening member is thus prevented from splashing at both ends of the roller cover at the time when the paint roller is at work.

7 Claims, 4 Drawing Sheets

PAINT ROLLER HAVING A DEVICE FOR FASTENING SECURELY ROLLER COVER

FIELD OF THE INVENTION

The present invention relates generally to a paint roller for applying paint, and more particularly to a fastening device of the roller cover of the paint roller.

BACKGROUND OF THE INVENTION

As shown in FIG. 1, a prior art paint roller 10 is used for applying paint and composed of a hand grip 11, a rotary shaft 12, a roller cover fastening device 13 fastened pivotally with the rotary shaft 12, and a roller cover 14 fastened with the device 13.

The roller cover fastening device 13 consists of a first cover body 13A, a second cover body 13B, and a plurality of metal wires 13C. The roller cover 14 has one side which is in contact with a retaining portion 13D of the outer peripheral surface of the first cover body 13A. The metal wires 13C are capable of being deformed by the inner wall 14A of the roller cover 14. The roller cover 14 is fastened with the fastening member 13 by the elastic force of the metal wires 13C such that the roller cover 14 is capable of swiveling along with the fastening member 13 in relation to the shaft 12.

The metal wires 13C are vulnerable to the metal fatigue. The roller cover 14 may be made without precision or sphericity. As a result, the axial displacement of the roller cover 14 is prone to take place. In addition, the roller cover 14 may be even detached. Moreover, the prior art paint roller 10 is further not effective in design in that the paint is prone to infiltrate into the fastening member 13 via a circular interstice 14B located between the outer peripheral surface of the second cover body 13B and the inner wall 14A of the roller cover 14, or via another side of the roller cover 14. The paint deposited in the fastening member 13 may splash unexpectedly through the circular interstice 14B at the time when the prior art paint roller 10 is at work.

SUMMARY OF THE INVENTION

The primary objective of the present invention is to provide a paint applying hand tool with a roller cover free from the drawbacks of the prior art roller cover described above.

In keeping with the principle of the present invention, the foregoing objective of the present invention is attained by an improved paint roller which is used for applying paint and is composed of a handle, a shaft extending from one end of the handle, and a roller cover fastening member rotatably engaged on the shaft and composed of a first cover body and a second cover body. The first cover body is provided in the outer periphery thereof with a retaining portion, which serves to locate and to seal off one end of the roller cover. The second cover body is provided in the outer periphery thereof with an elastic protuberance capable of locating and sealing off another end of the roller cover. The first cover body and the second cover body are capable of preventing the axial displacement of the roller cover and the splashing of the paint from both ends of the roller cover at the time when the paint applying hand tool of the present invention is at work.

The foregoing objective, features and functions of the present invention will be more readily understood upon a thoughtful deliberation of the following detailed description of the present invention with reference to the accompanying drawings.

DETAILED DESCRIPTION OF THE INVENTION

Figure 1:
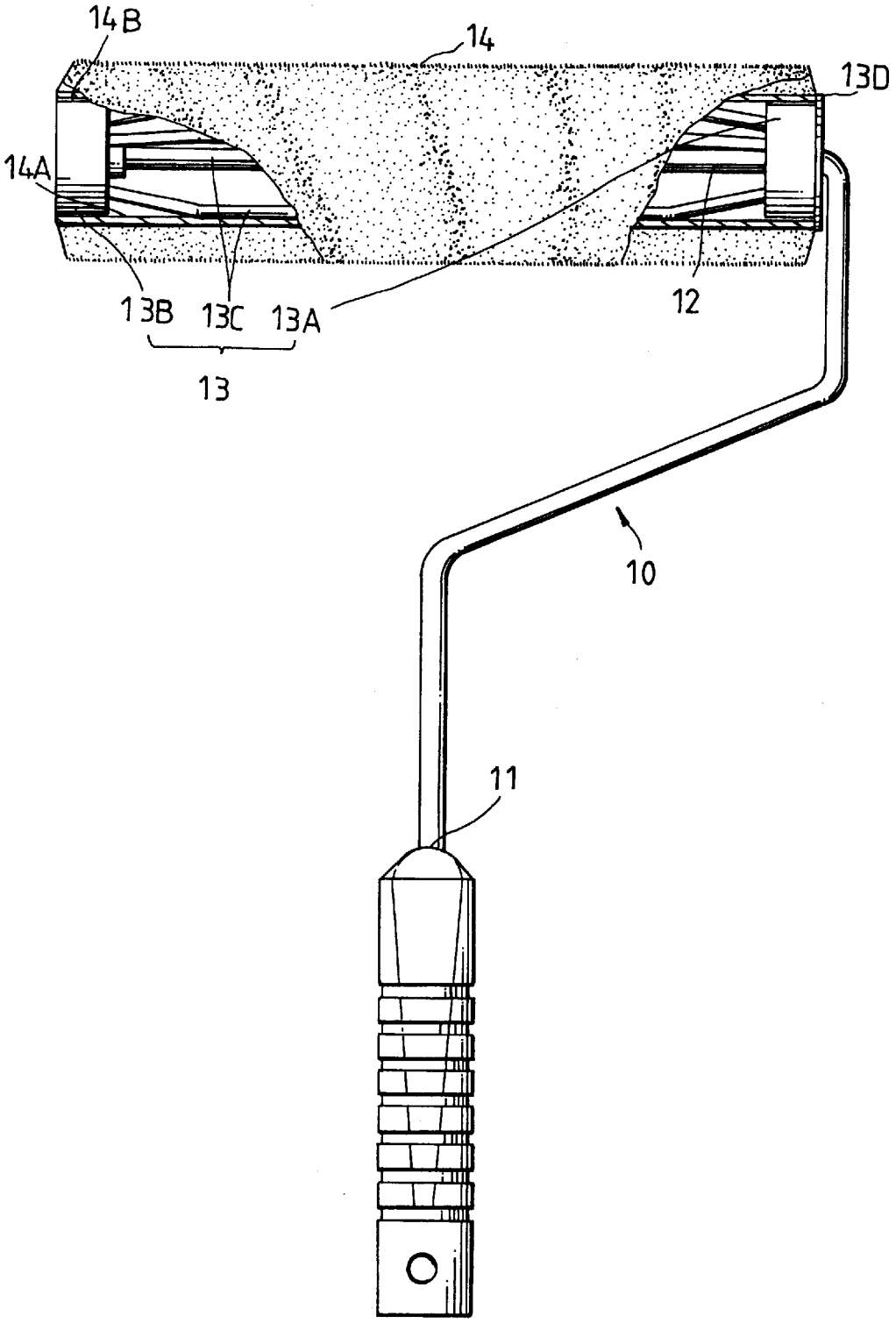
FIG. 1 (PRIOR ART)
FIG. 1 shows a schematic view of a paint roller of the prior art.
Figure 2:
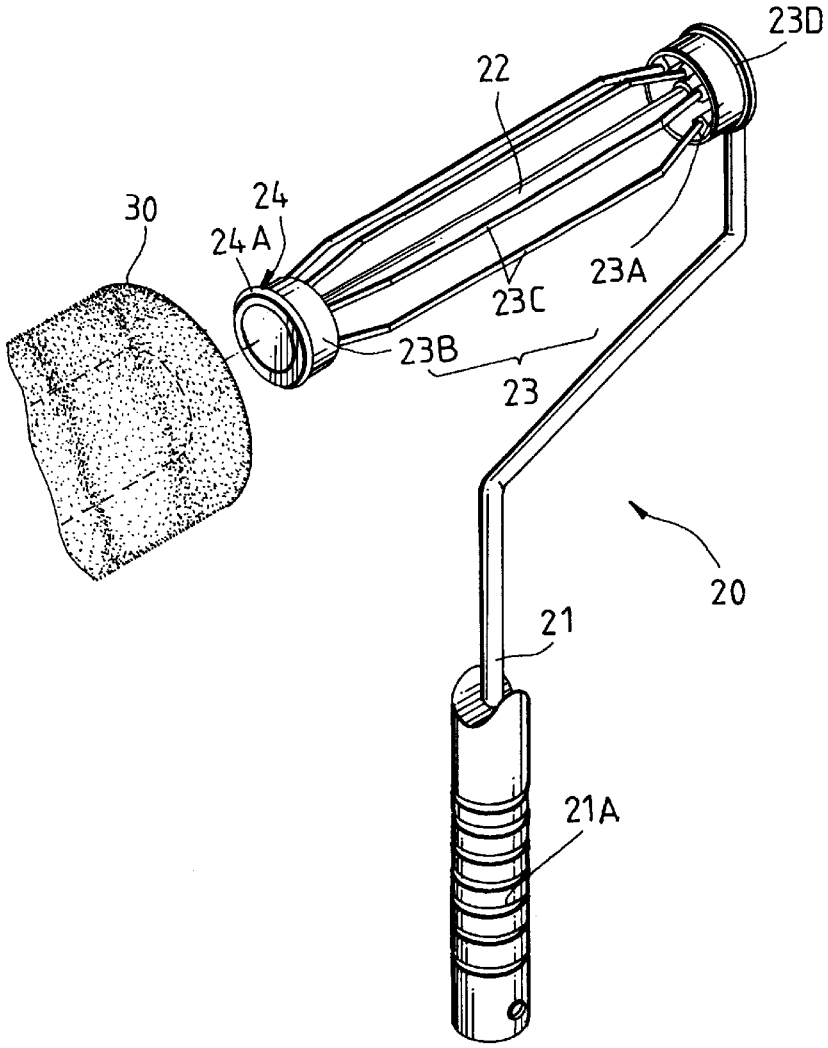
FIG. 2 shows a perspective view of a paint roller of a first preferred embodiment of the present invention.
Figure 3:
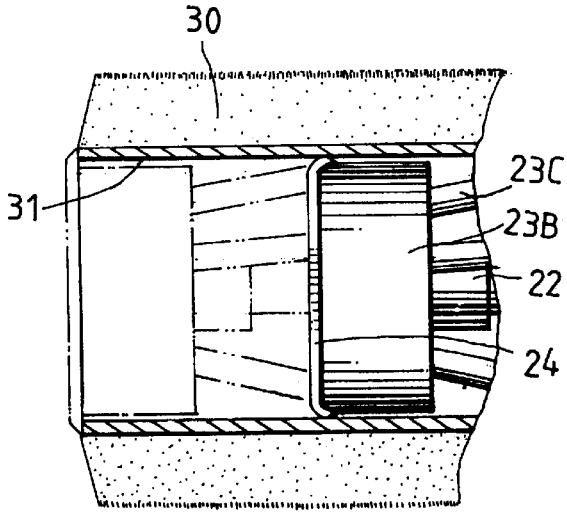
FIG. 3 shows a partial sectional view of the first preferred embodiment of the present invention.
Figure 4:
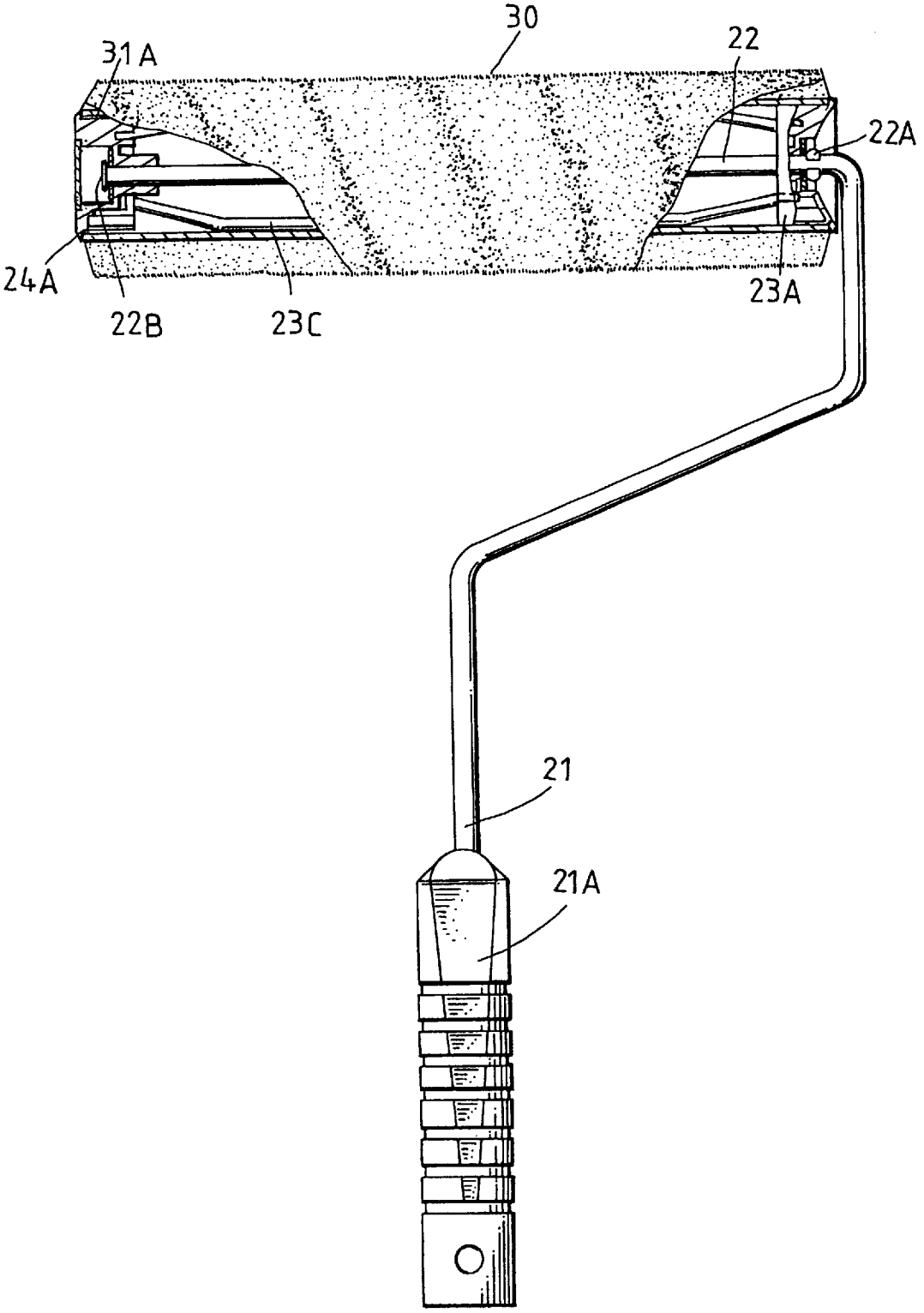
FIG. 4 shows a schematic view of the first preferred embodiment of the present invention.

As shown in FIGS. 2–4, a paint roller 20 of the first preferred embodiment of the present invention is composed of a handle 21, a shaft 22, a roller cover 30, and a roller cover fastening member 23.

The handle 21 is provided at the free end thereof with a hand grip 21A.

The shaft 22 is extended from another end of the handle 21 such that the shaft 22 is curved, and that the axis of the rotary shaft 22 and the axis of the handle 21 form an angle of 90 degrees. The shaft 22 is covered with the roller cover 30, as shown in FIGS. 3 and 4.

The roller cover fastening member 23 is made up of a first cover body 23A, a second cover body 23B, and a plurality of metal wires 23C. The first cover body 23A and the second cover body 23B are rotatably engaged with two ends of the longitudinal axis of the shaft 22 such that the first cover body 23A and the second cover body 23B are confined between a protruded block 22A of the shaft 22 and a free end 22B of the shaft 22. The first cover body 23A is provided in the outer periphery thereof with a retaining portion 23D made integrally therewith, whereas the second cover body 23B is provided in the outer periphery thereof with an elastic protuberance 24 made integrally therewith. The first and the second cover bodies 23A and 23B are made of a plastic material. The elastic protuberance 24 are made of a plastic material by one or two injection moldings. The elastic protuberance 24 has a tapered portion 24A.

The roller cover 30 is fitted over the fastening member 23 from the outside of the second cover body 23B, as shown in FIG. 3, in the direction toward the first cover body 23A such that an inner wall 31 of the roller cover 30 presses against the elastic protuberance 24 to deform until such time when the protuberance 24 is moved to locate at one end of the roller cover 30, where the deformed protuberance 24 regains its original shape to seal off a circular interstice 31A located between the outer periphery of the second cover body 23B and the inner wall 31 of the roller cover 30. The roller cover 30 is thus confined between the elastic protuberance 24 and the retaining portion 23D such that the roller cover 30 is prevented from displacing along the longitudinal axis of the fastening member 23. In addition, the splashing of the paint deposited in the fastening member 23 is prevented, thanks to the elastic protuberance 24 and the retaining portion 23D which are capable of obstructing the splashing of the paint at both ends of the roller cover 30. The worn-out roller cover 30 can be forced out of the fastening member 23 in a direction opposite to the direction in which the roller cover 30 is fitted over the fastening member 23 in the first place. The tapered portion 24A serves to facilitate the fitting of the roller cover 30 over the fastening member 23. The elastic protuberance 24 has a height ranging preferably between 2–3 mm.

Figure 5:
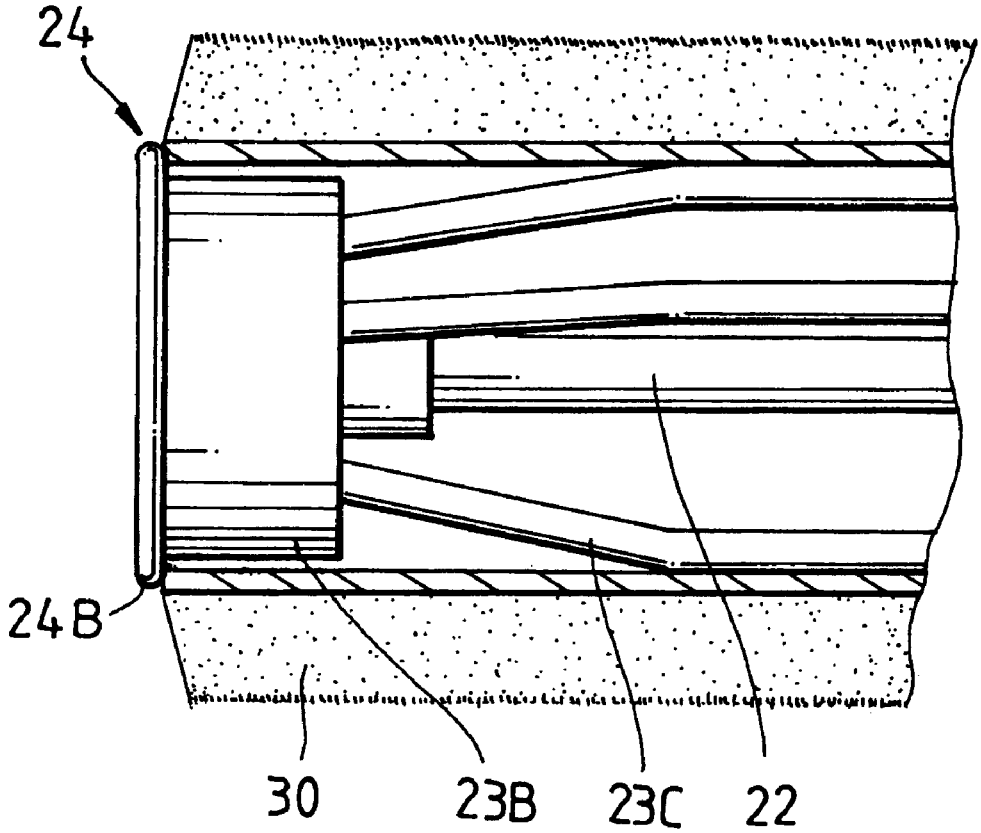
FIG. 5 shows a partial enlarged sectional view of a second preferred embodiment of the present invention.

The embodiment of the present invention described above is to be deemed in all respects as being merely illustrative and not restrictive. Accordingly, the present invention may be embodied in other specific forms without deviating from the spirit thereof. For example, the elastic protuberance 24 may be modified in such a way that the elastic protuberance 24 is provided with a smooth outer surface 24B, as shown in FIG. 5, to facilitate the fitting of the roller cover 30 over the fastening member 23 and to facilitate the forceful removal of the roller cover 30 from the fastening member 23. The present invention is therefore to be limited only by the scopes of the following appended claims.

What is claimed is:

1. A paint roller comprising:

a handle;

a shaft extending from one end of said handle such that said rotary shaft forms an angle with said handle;

a fastening member rotatably engaged on said shaft and composed of a first cover body and a second cover body opposite in location to said first cover body, said first cover body provided in an outer periphery thereof with a retaining portion; and a roller cover fitted over said fastening member such that one end of said roller cover is located and sealed off by said retaining portion of said first cover body;

wherein said second cover body is provided in an outer periphery thereof with an elastic protuberance integral with said second cover body for locating and sealing off another end of said roller cover;

wherein said roller cover is confined between said retaining portion of said first cover body and said elastic protuberance of said second cover body such that said roller cover is prevented from displacing along the direction of a longitudinal axis of said fastening member.

2. The paint roller as defined in claim 1, wherein said elastic protuberance is made of a plastic material.

3. The paint roller as defined in claim 1, wherein said elastic protuberance has a tapered portion.

4. The paint roller as defined in claim 1, wherein said elastic protuberance has a smooth outer surface.

5. The paint roller as defined in claim 1, wherein said elastic protuberance has a height ranging between 2 mm and 3 mm.

6. The paint roller as defined in claim 1, wherein said first cover body and said second cover body are fixed together by metal wires.

7. The paint roller as defined in claim 6, wherein the metal wires are deformably engaged to the roller cover.

* * * * *